US007975988B2

(12) United States Patent
Thomson et al.

(10) Patent No.: US 7,975,988 B2
(45) Date of Patent: Jul. 12, 2011

(54) DEVICE FOR CARBONATING A LIQUID WITH PRESSURIZED GAS

(75) Inventors: Michael Anthony Thomson, Peterborough (GB); Antony Frank Pateman, Peterborough (GB)

(73) Assignee: Soda-Club Ltd., Ben Gurion Airport (IL)

( * ) Notice: Subject to any disclaimer, the term of this patent is extended or adjusted under 35 U.S.C. 154(b) by 1063 days.

(21) Appl. No.: 11/576,189

(22) PCT Filed: Aug. 23, 2005

(86) PCT No.: PCT/EP2005/054128

§ 371 (c)(1),
(2), (4) Date: Apr. 9, 2007

(87) PCT Pub. No.: WO2006/034930

PCT Pub. Date: Apr. 6, 2006

(65) Prior Publication Data

US 2007/0257380 A1 Nov. 8, 2007

(30) Foreign Application Priority Data

Sep. 29, 2004 (EP) ..... 04023182

(51) Int. Cl.
*B01F 3/04* (2006.01)

(52) U.S. Cl. ..... 261/65; 261/74; 261/DIG. 7; 99/323.1; 426/477

(58) Field of Classification Search ..... 261/64.1, 261/65, 74, 121.1, 122.1, DIG. 7; 99/323.1, 99/323.2; 426/477

See application file for complete search history.

(56) References Cited

U.S. PATENT DOCUMENTS

| | | | | |
|---|---|---|---|---|
| 2,628,828 | A | | 2/1953 | Meurer |
| 2,805,846 | A | * | 9/1957 | Dewan ..... 261/121.1 |
| 3,772,187 | A | | 11/1973 | Othmer |
| 3,953,550 | A | | 4/1976 | Gilbey |
| 4,082,123 | A | | 4/1978 | Haythornthwaite et al. |
| 4,237,693 | A | | 12/1980 | Maslen et al. |
| 4,292,540 | A | | 9/1981 | Thompson et al. |
| 4,323,090 | A | | 4/1982 | Magi |
| 4,342,710 | A | | 8/1982 | Adolfsson et al. |
| 4,391,762 | A | * | 7/1983 | Child et al. ..... 261/121.1 |
| 4,401,607 | A | * | 8/1983 | Child et al. ..... 261/121.1 |
| 4,422,371 | A | * | 12/1983 | Child et al. ..... 99/323.1 |
| 4,457,877 | A | * | 7/1984 | Love et al. ..... 261/64.3 |
| 4,610,282 | A | | 9/1986 | Brooks et al. |
| 5,549,037 | A | * | 8/1996 | Stumphauzer et al. ..... 99/323.1 |

(Continued)

FOREIGN PATENT DOCUMENTS

CA 2261560 8/1999

(Continued)

*Primary Examiner* — Scott Bushey
(74) *Attorney, Agent, or Firm* — Shoemaker and Mattare

(57) ABSTRACT

A device for carbonating a liquid (L) in a container (10) with a pressurized gas (G) comprises a receiving flask (20) for the container (10) and a filling head (30) which has means (31) for adding gas into said liquid in the container (10). The receiving flask (20) and the filling head (30) are movable in relation to each other between an insertion position (I) and a carbonating position (C). In the insertion position (I) the filling head (30) is spaced from the receiving flask (20). In the carbonating position, the receiving flask (20) and the filling head (30) are in contact with each other such as to form a substantially closed cavity (19). An interlocking connection directly connects the receiving flask (20) to the filling head (30).

24 Claims, 10 Drawing Sheets

U.S. PATENT DOCUMENTS

Figure 1:
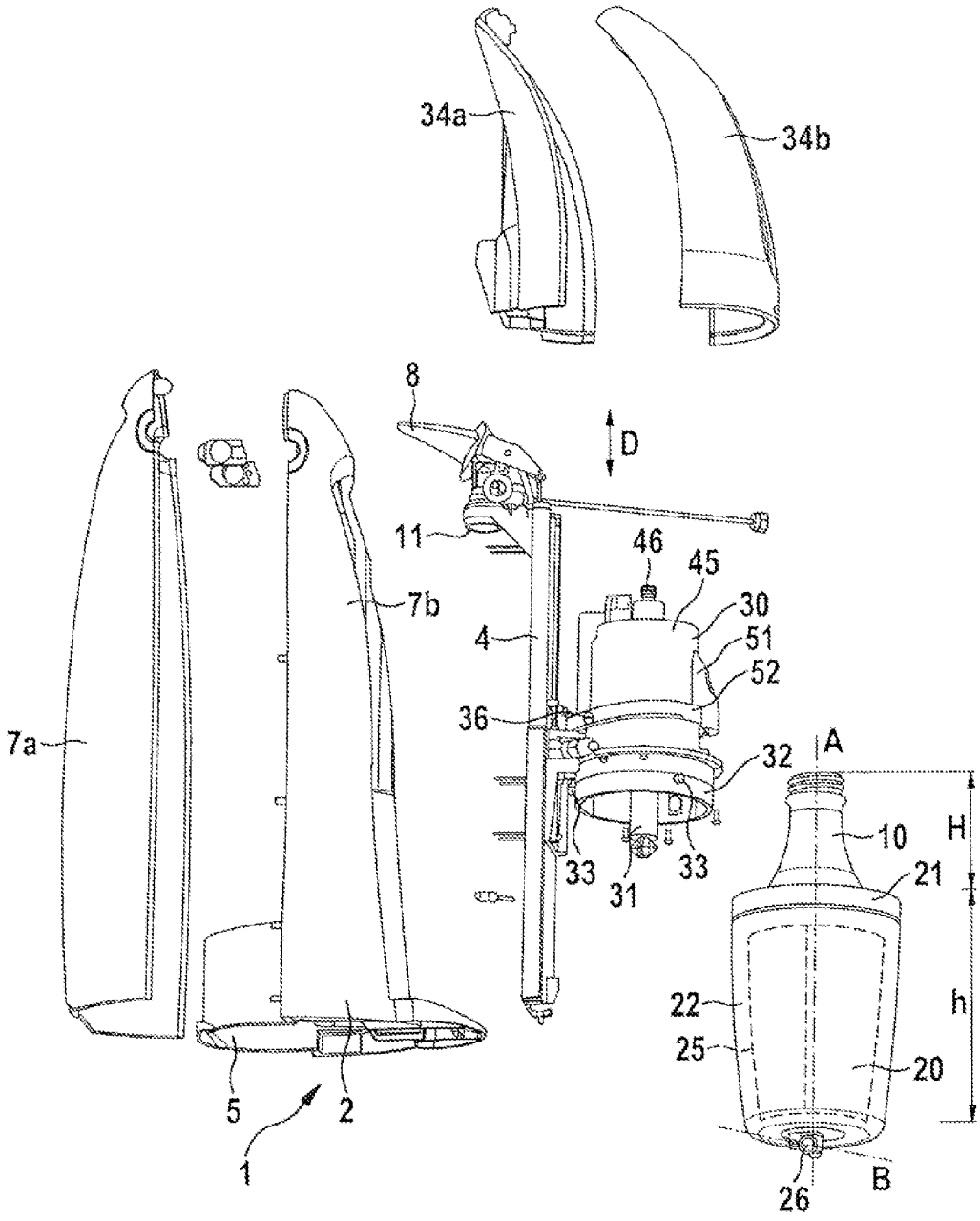

| | | | | |
|---|---|---|---|---|
| 5,635,232 | A * | 6/1997 | Wallace | 426/397 |
| 6,439,549 | B1 * | 8/2002 | Loov | 261/121.1 |
| 6,742,772 | B2 * | 6/2004 | Kiefer | 261/65 |
| 7,438,285 | B2 * | 10/2008 | Maritan et al. | 261/64.1 |
| 2003/0075813 | A1 | 4/2003 | Kiefer | |

FOREIGN PATENT DOCUMENTS

| | | |
|---|---|---|
| DE | 674512 | 4/1939 |
| DE | 19805198 | 8/1999 |
| EP | 0000813 | 2/1979 |
| EP | 935 993 | 2/1999 |
| EP | 1005897 | 6/2000 |
| EP | 1224966 | 7/2002 |
| EP | 1354622 | 10/2003 |
| EP | 1378484 | 1/2004 |
| GB | 2002417 | 2/1979 |
| WO | 00/07706 | 2/2000 |
| WO | 00/77442 | 12/2000 |
| WO | 02/057003 | 7/2002 |
| WO | 2004/037706 | 5/2004 |

* cited by examiner

DEVICE FOR CARBONATING A LIQUID WITH PRESSURIZED GAS

The invention relates to a device for carbonating water and/or another liquid contained in a container with a pressurized gas according to the preamble of the independent patent claims.

Carbonating devices which enable carbon dioxide to be dissolved in water are widely used for home applications. By means of such devices, users may prepare carbonated beverages at home.

Common carbonating devices are provided with a carbonating head to which a container containing the liquid is sealed prior to the release of carbon dioxide into it. The filling head is connected to a pressurized carbon dioxide cylinder. Such a carbonating device is e.g. shown in EP 1 235 637. Other carbonating devices are e.g. known from EP 935 993, WO00/07706, EP 1 005 897, WO 2004/03706, WO00/77442, EP 1 378 484 or EP 813.

While such devices are widely used nowadays, they still have certain drawbacks, mainly related to ease of handling. In order to establish a good seal between the container containing a liquid and the carbonation head, the container mouth must be brought to the filling head and by such means the two are connected by, for example, screwing one to the other so that a perfect seal is achieved. This manual action is inconvenient and time-consuming. The users' preference is always for easy handling.

Current devices mainly use containers which are made from ductile plastic (e.g. PET) in order to minimize the risks which might result if, upon pressurization of a more brittle material, such as glass, were to shatter. In case of over pressurization of the container, a ductile bottle will expand rather than shatter into many pieces. However, glass bottles are generally preferred because they can be more easily washed, particularly at high temperatures, whereas plastic may very often deform and lose its important physical properties. Glass is also considered more aesthetic. Glass bottles in excess of over 0.33 litre are generally not used by the manufacturers of carbonating devices in view of the risk of bursting in case of over pressurization.

In U.S. Pat. No. 4,323,090 or U.S. Pat. No. 4,342,710, it had been suggested to provide a carbonating device with a burst protection shield for the liquid container and with a mechanism for forming a sealing connection between a carbonating head and the container without the need of screwing the bottle into the carbonating head. These solutions have, however, certain drawbacks when used with bottles in excess of 0.33 litre because of the upward and downward thrust caused by the bursting of a larger bottle, which are sufficiently high to demolish the carbonating device releasing shards of glass from beneath the shield referred to in more detail below.

U.S. Pat. No. 4,342,710 or U.S. Pat. No. 4,323,090 do have a certain burst protection. This protection, however, may be ineffective in case of ballistic energy that is released upon the failure of a glass bottle of 0.5 litre volume. In particular, the shield which comes over the bottle, upon the occurrence of a burst bottle, may be lifted upwardly thus opening a gap between the lower end of the shield and the stand of the machine onto which the bottle is placed. Through this gap, glass particles, which are not contained by the protective shield, are likely to be released and injure the user. The locking mechanisms locking the shield to the body of the machine may not be sufficiently strong to protect the components of the carbonating device, especially in the event of an empty bottle failure. Usually the device is blown apart into many pieces if the bottle has a volume in excess of 0.5 litres.

It is an object of the present invention to overcome the drawbacks of the prior art especially to provide a carbonating device allowing the use of glass bottles even with a relatively large volume such as 0.5 or one litre. It is a further object of the invention to provide a carbonating device allowing easy connection of the container with the device and easy removal of the container from the device. According to the present invention, these objects are solved with a device for loading a liquid with a pressurized gas in accordance with the features of independent patent claims.

The device is especially suitable for dissolving carbon dioxide under pressure in water contained in a glass or plastic bottle. According to the invention, the device is provided with a receiving flask into which a container or bottle may be inserted. A carbonating or filling head is provided with means for bubbling the gas through the liquid in the container which is sealed within the carbonating device.

The carbonating head is integrated with the carbonating device so that it can be moved up and down in relation to the receiving flask in order to enable the carbonating head to be applied to the open orifice of the container or bottle, which has been inserted in the flask, rather than the container being manually brought and applied to the carbonating head, which is the current methodology. In the open or insertion position, the carbonating head is located sufficiently above the receiving flask in order to enable a container or bottle to be placed into the flask. The filling head, the flask or both could be designed to move. The outer shroud surrounding the filling head and the receiving flask are locked together by a bayonet fitting or by some other suitable means.

When the carbonating head is disconnected from the flask, the container may be inserted into it without the carbonating head obstructing the process. Because the carbonating head and the cavity together form a substantially securely closed cavity, glass bottles can be used. In case of bursting of the glass bottle the flask and shroud of the carbonating head form a burst protection.

According to the invention, the carbonating head and the receiving flask are provided with means for interlocking connection there between. This can be preferably a bayonet connection. Other locking means such as a threaded connection or a locking mechanism with a movable latch like element would be conceivable.

By means of an axial interlocking connection between the filling head and the receiving flask, a very secure cavity and thereby a secure anti-burst protection is formed. Because of the direct connection between the flask and the filling or carbonating head in an axial direction, the cavity will resist high internal forces which may be created in case of bursting of a glass bottle, even if it is empty.

The flask can be of any appropriate size and shape and be designed so as to fit to a receiving platform on the device and to directly interlock with that platform so that it remains in a constant position for the purposes of inserting a container and in a second position during the carbonation process, when it is locked to the shroud of the carbonating head. The method of interlock referred to also allows it to be easily removed when and if necessary.

The device according to the invention is intended or designed for a specific size and type of containers. The receiving flask is preferably sufficiently high to contain the container which is inserted into it, e.g. at least 50% of the height of the container. Relatively high internal dimensions allow for easy insertion without the risk of the container falling out. This is especially preferred in case of glass bottles which could break when tilting or falling down from the device.

In a preferred embodiment, the flask can be mounted rotateably around an axis which is substantially parallel to the movement direction of the flask and/or of the filling head. With such a design, a bayonet closure can be easily used. Engagement or disengagement between a bayonet element on the receiving flask and a bayonet element on the filling head can be achieved by simply rotating the receiving flask. Of course, it would also be conceivable to provide a rotateable connection element on the filling head and to rigidly mount the receiving flask.

According to still a further embodiment of the invention, the receiving flask can be pivotably mounted and interlocked on a place which is titled in relation to the horizontal place of the device. For easy removal or insertion of the container into the receiving flask, the receiving flask can be slightly pivoted or tilted away from the movement axis of the flask and/or of the filling head. This allows for even easier removal or insertion of the container. It is especially preferred to mount the flask in such a way that it is automatically moved into a tilted position, preferably a position having an angle of 15 degrees between the axis of the flask and the movement direction of the filling head and/or of the receiving flask. By automatically tilting the flask, the flask is always in a position for removal/insertion of the container unless the flask is brought into the carbonating position. Automatic tilting can be achieved e.g. by a rotateable mounting of the flask in such a way, that by means of gravity, the flask tends to tilt.

It is also possible to provide an additional member for tilting the receiving flask when the carbonating head has reached the insertion position. This may be formed by a tilting button which is actuated by a cam upon upward movement of the filling head.

According to a further preferred embodiment, the device is further provided with at least one release or dump valve for releasing overpressure from the container and/or the cavity. The device is provided with release members such as a lever for actuating said release valve.

According to a preferred embodiment of the invention the interlocking engagement between the flask and the filling head is designed in such a way that it can be opened or disengaged only after the pressure within the cavity and/or the bottle has been released. In case of a bayonet connection this can be e.g. done by providing the interlocking mechanism with a ramp surface.

The ramp ensures also that no accidental rotation can be performed by the users while the machine is under pressure.

In order to overcome the ramp, before opening the bayonet closure, the flask and the head need to be put closer together in an axial direction. This can only be achieved if there is not a too high internal pressure. It is, however, also conceivable to provide other safety mechanisms. It would e.g. be possible to block mechanically the rotation of a flask until the release lever has been actuated.

According to a further preferred embodiment of the invention, the device may be provided with spring means for automatically moving the head and/or the receiving flask into the insertion position as soon as the connection between the flask and the head has been disengaged. This can e.g. be achieved by means of a gas spring supporting the filling head in axial direction. By means of such spring arrangement, the filling head is automatically moved into the insertion position as soon as a carbonated container is removed from the device. The device will then be automatically ready for insertion of a new container. This is especially advantageous in context with a tiltable flask as described above.

According to a further embodiment of the invention the filling head is mounted movably along a guide rail on a support of the device. Because of the direct interlocking connection for forming a closed cavity between the receiving flask and the filling head in an axial direction, the support and the guide rails only have the function of holding the filling head in the insertion position and bringing the filling head into the carbonating position. In the carbonating position, no forces from the filling head act onto the guide rail or the support. This makes dimensioning and design of the support and the guide rails much easier.

The receiving flask is made of a material with dimensions sufficient to withstand internal forces such as to form an efficient anti-burst protection. Typically, the use of stainless steel for the receiving flask is preferred. For a 1.0 l bottle, a receiving flask with an internal diameter of 112 mm and with a thickness of the wall of 0.6 mm has been found to be suitable.

According to a further preferred embodiment, the filling head basically consists of a support made from a material dimensioned in a way sufficient to withstand internal forces. Typically, the filling head can comprise a support cast from aluminium and provided with openings for a carbonating conduit or for a path for pressure release. Especially if connecting elements such as a groove and pin of a bayonet connection are made from metal parts, a reliable connection can be achieved.

The receiving flask can be further provided with a holding insert or basket for holding the container. This insert may be typically made of a resilient material such as a plastic material. The insert is used to position and hold the container in its place. It may also act as a protection for the container for avoiding a direct contact between the glass container and the metal support flask.

According to a further preferred embodiment of the invention, the device is provided with a path for release of overpressure. This path can be formed in a tortuous, curved manner. Thereby a kind of labyrinth is formed preventing glass particles from being carried outside of the cavity in the gas stream. Such a tortuous path may be formed by means of angled or curved passages in a plastic insert arranged within the support of the filling head.

According to still a further embodiment of the invention, the device can be provided with a float mechanism. A float mechanism is used to prevent carbonating of an empty or not sufficiently filled container. Such a float can be realized by means of a floating body which presses a seal against an opening in the path of the gas. As soon as this opening is sealed, the container can be carbonated. If this opening is open, gas will exit through this opening to the atmosphere and no carbonation can be made.

The device can be further provided with tripping means for tripping safety valves each time the filling head is lowered and/or raised. In a preferred embodiment, tripping is made each time the filling head is lowered. By this, it is made sure before each carbonating step that safety valves are not blocked. This can be especially achieved by a cam mechanism actuating valve plungers during lowering of the filling head.

In another aspect and according to a further embodiment of the invention, the device may be further provided with a generator for creating electrical energy. In certain applications, it might be useful to have electric power in the device in order to create a sound or for indicating user information. As, however, such devices should be easily useable at different locations, it is not convenient to provide them with a power supply such as batteries or a connection to a mains supply. The generator could e.g. be provided with a turbine arranged in the path for the streaming gas, e.g. the gas produced during pressure release. It would also be possible to provide a generator driven by the movement of the filling head such that upon movement between the insertion position and the carbonating position, electrical energy will be created.

According to a further preferred embodiment of the invention and according to further aspects of the invention, the device may be provided with an insertion opening for inserting a carbon dioxide cylinder into the device without the need of lifting or turning the device. This can be achieved by providing an opening in the bottom of the device which is axially aligned with a connection for the carbon dioxide cylinder.

Figure 2A:
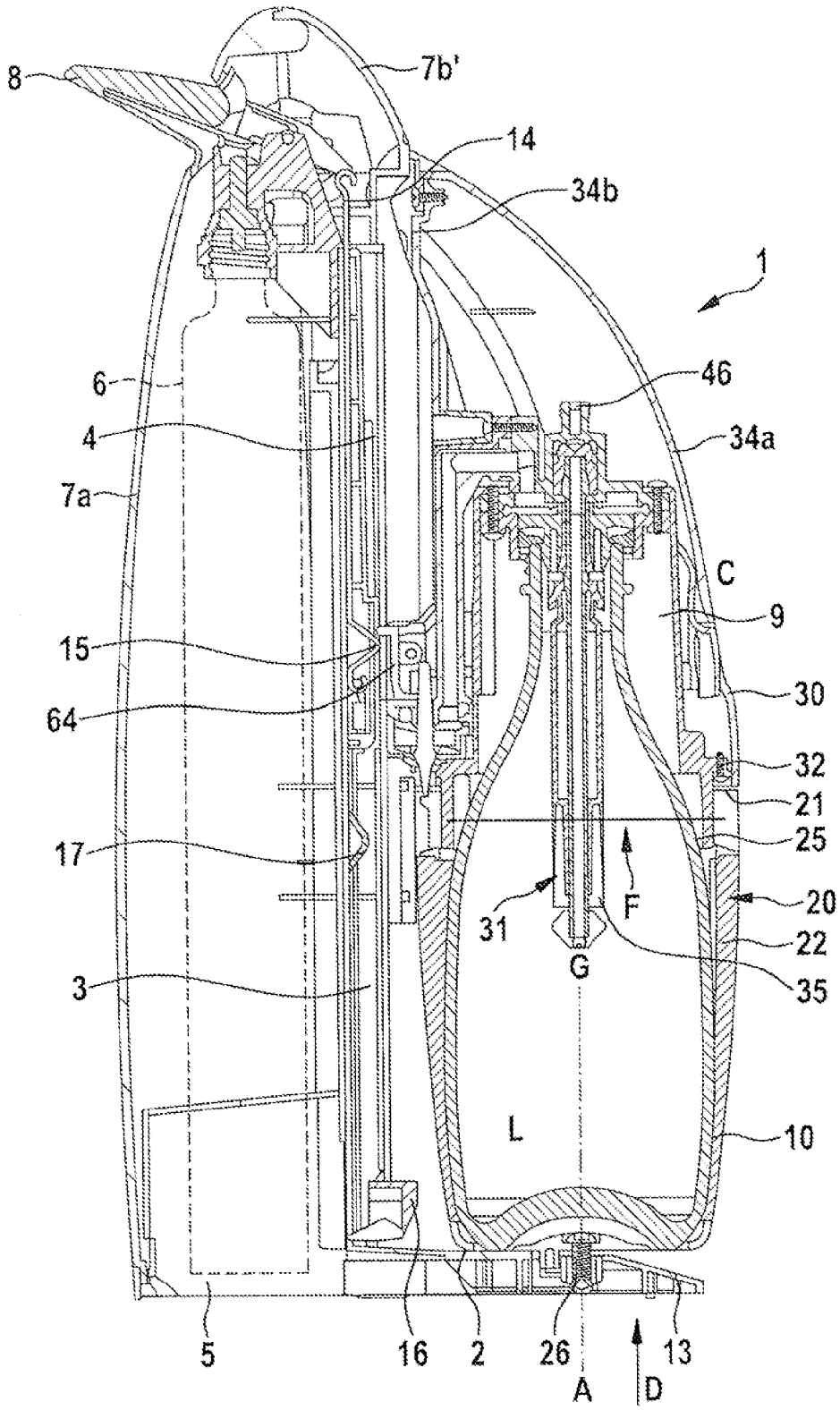
Figure 2B:
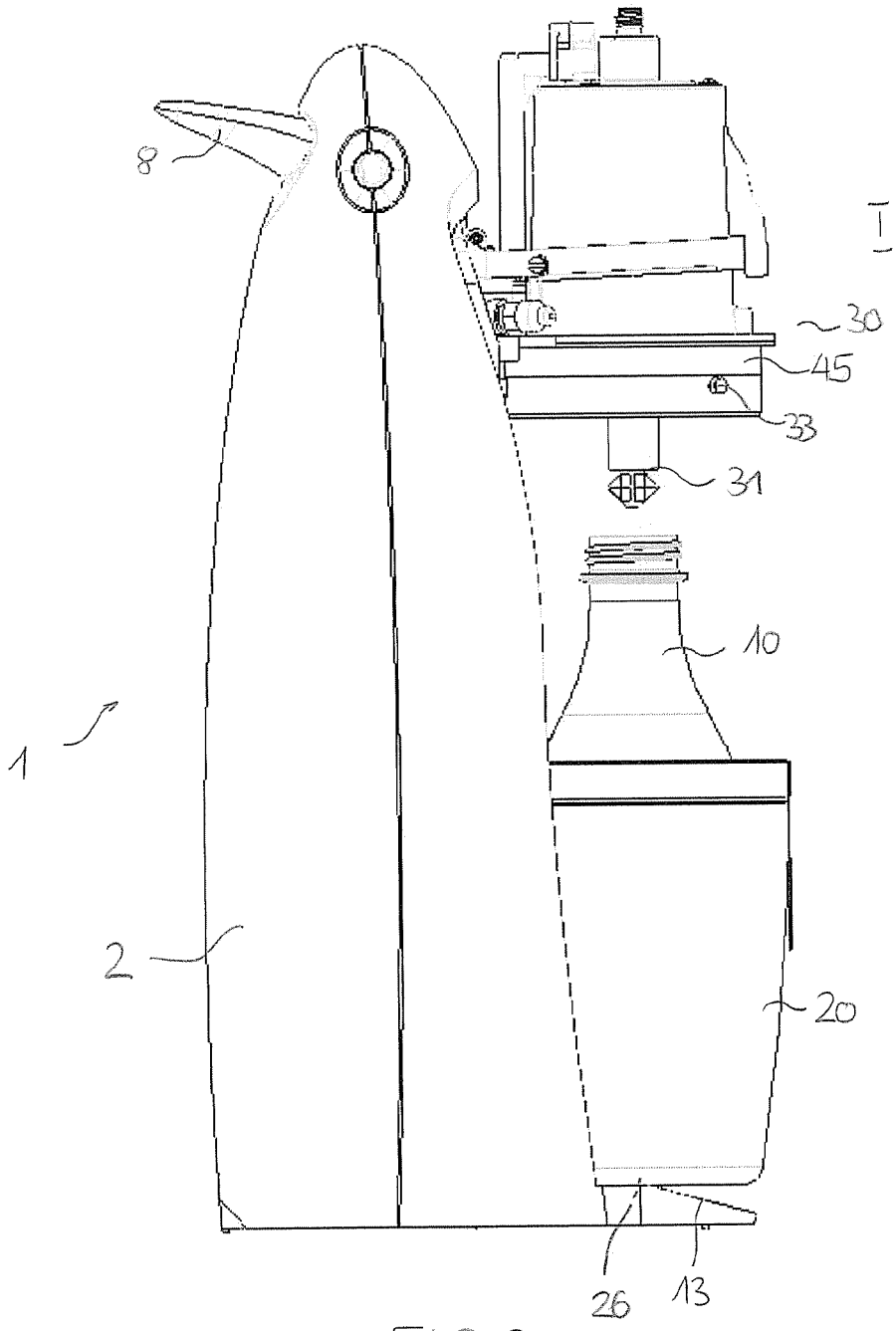
Figure 2C:
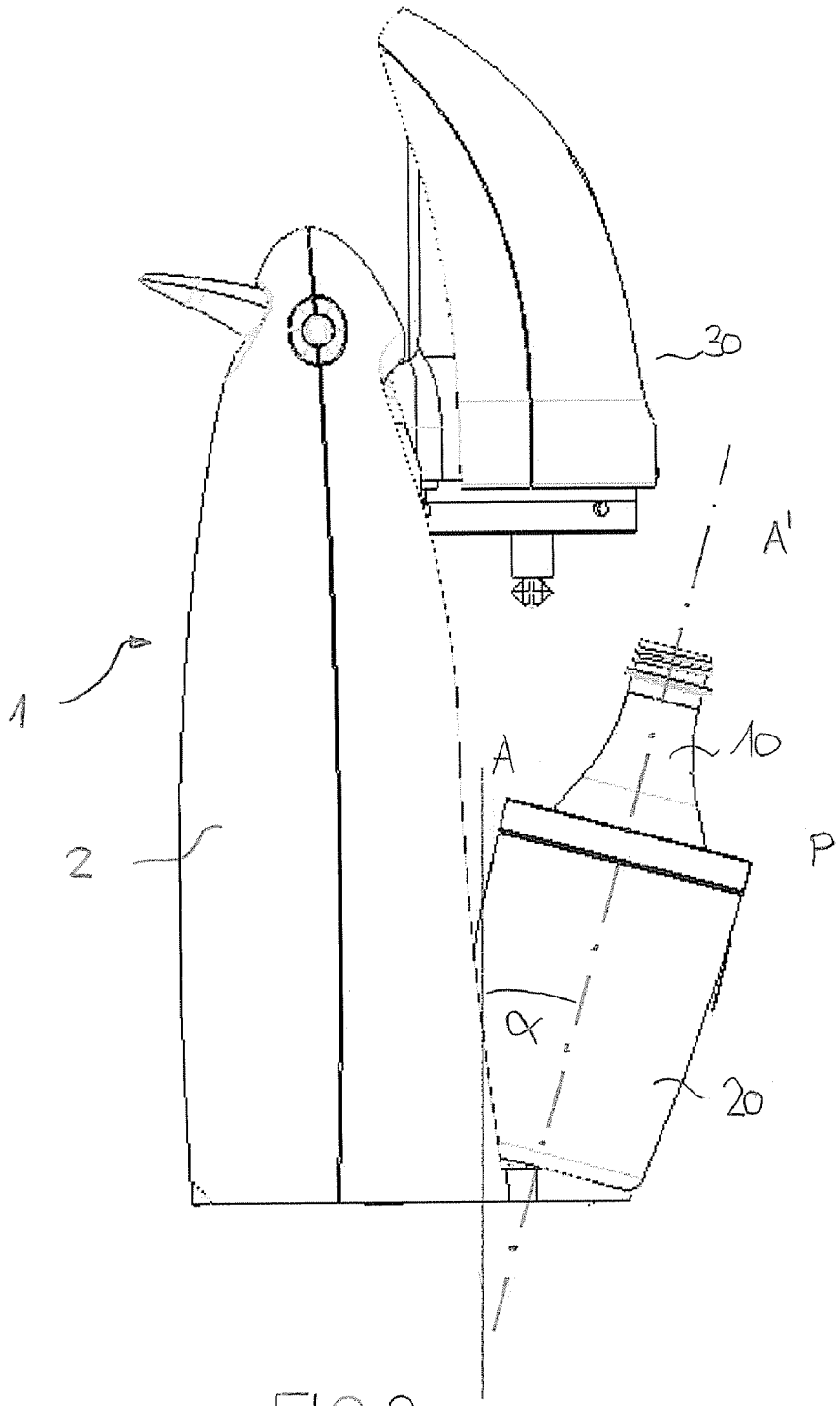
Figure 3A:
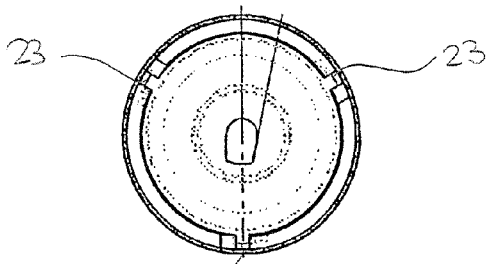
Figure 3B:
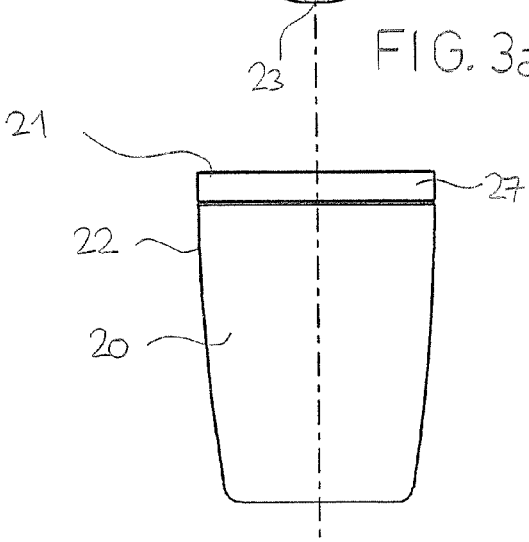
Figure 3C:
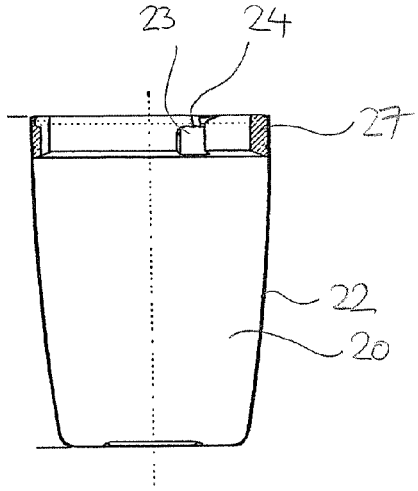
Figure 4:
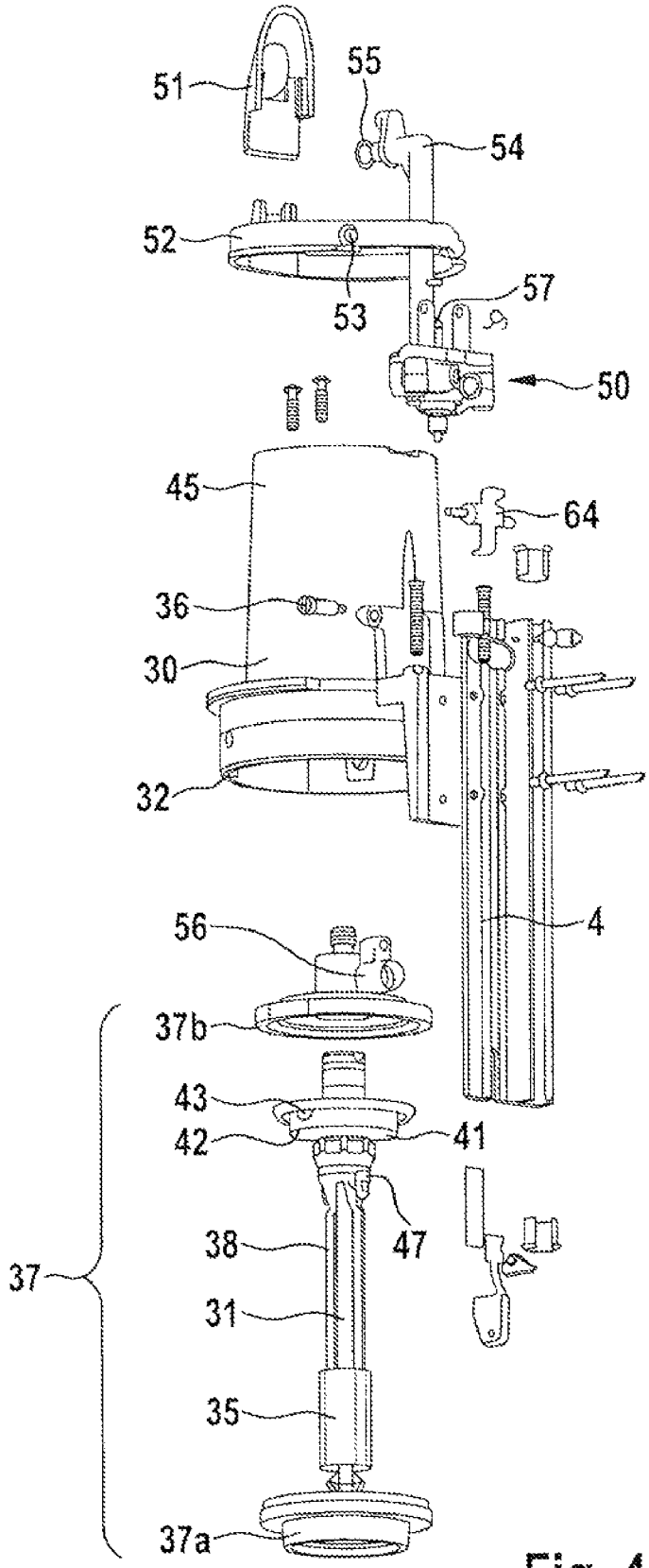
Figure 5:
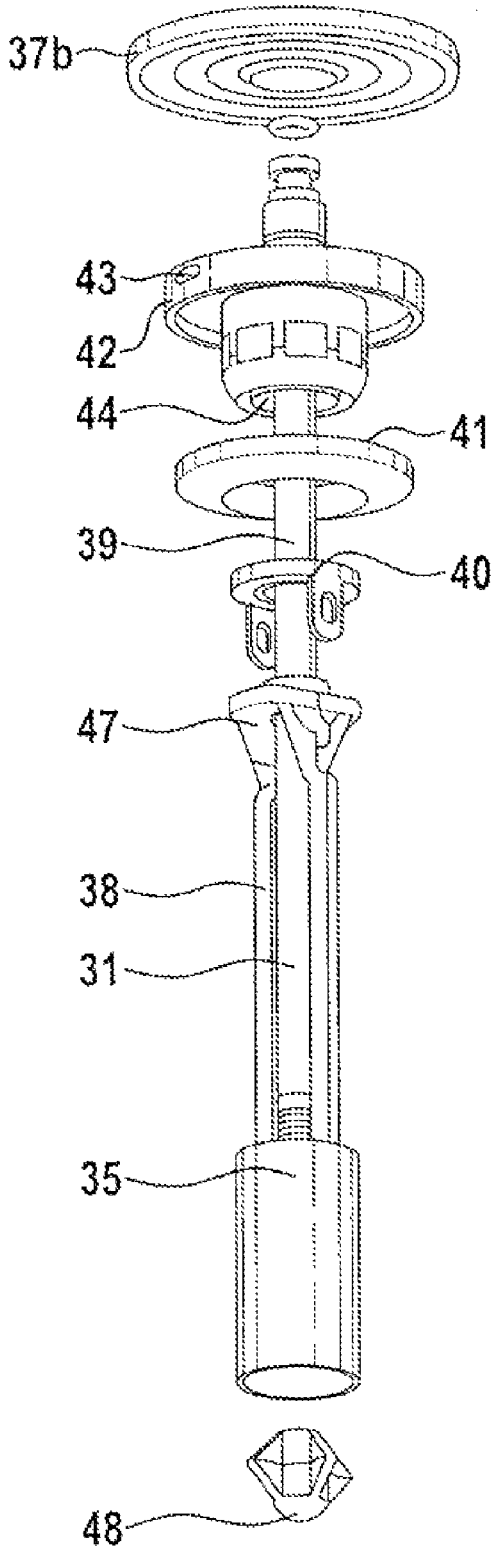
Figure 6:
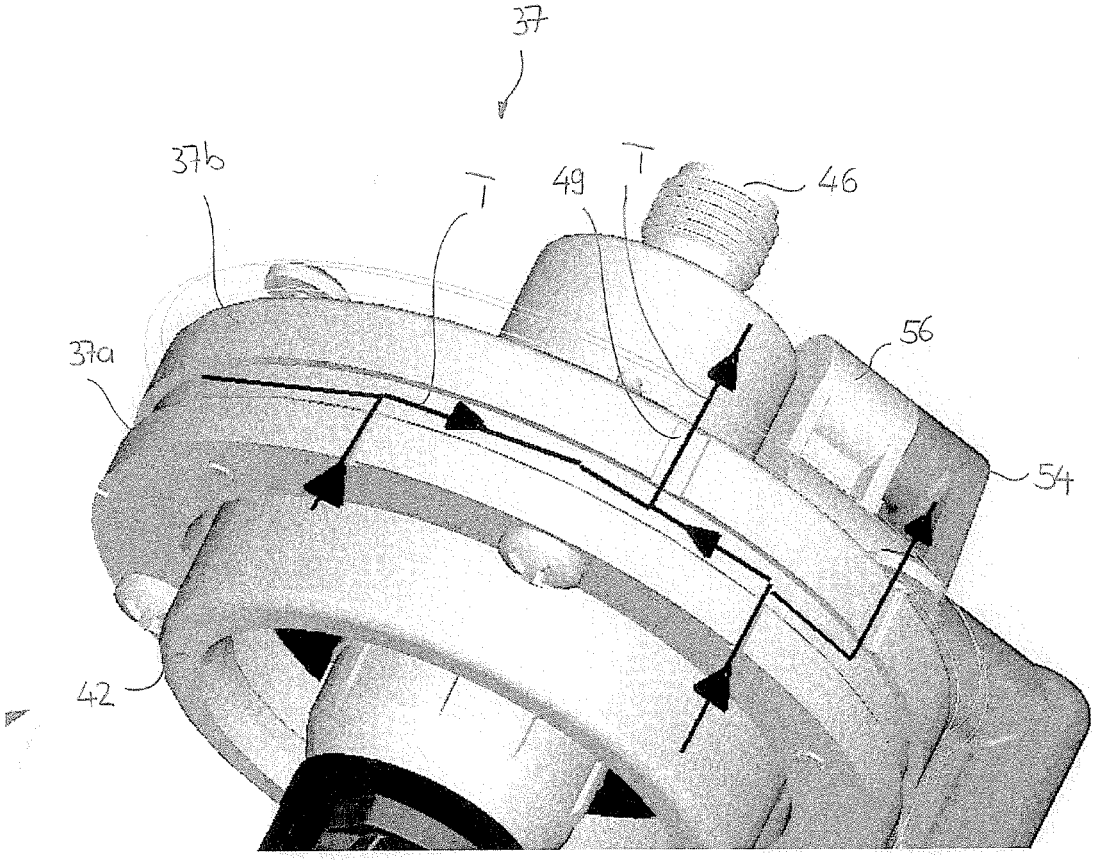
Figure 7:
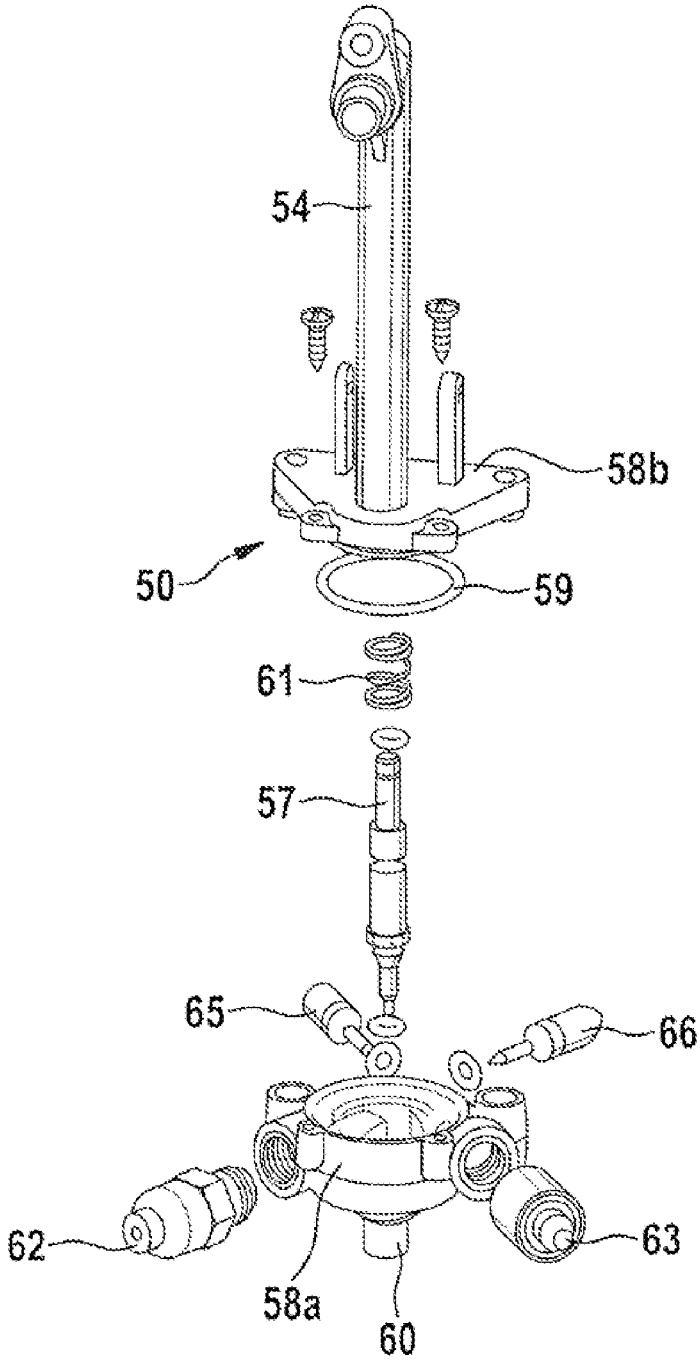
Figure 8:
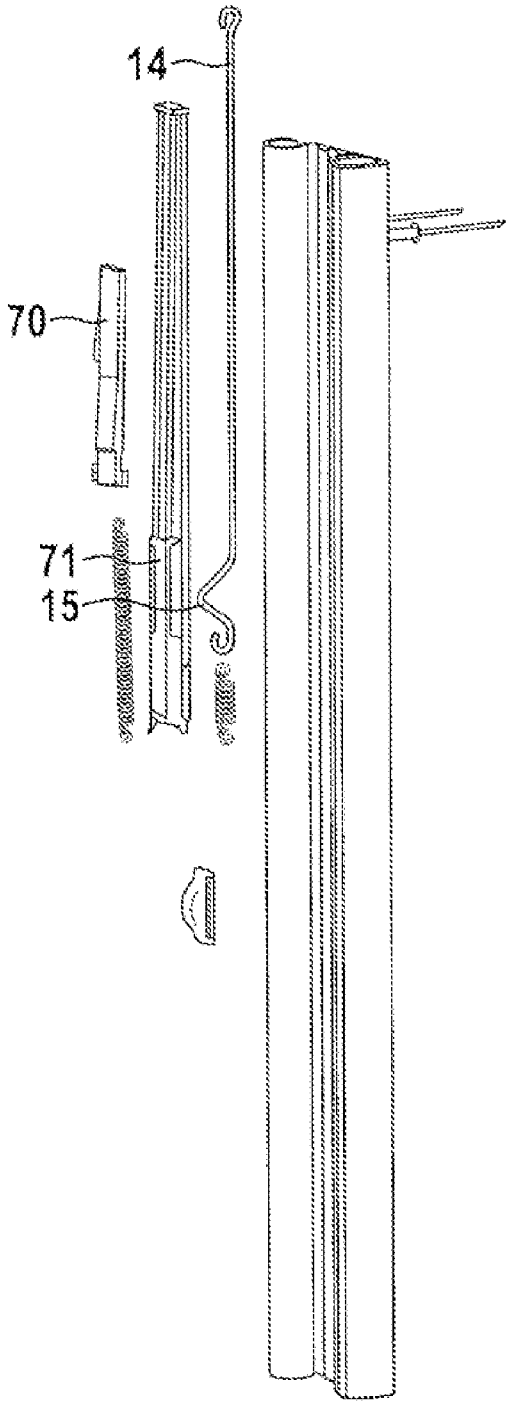

The invention will now be better understood with reference to the following description taken in combination with the accompanying drawing, in which:

FIG. 1 is an exploded view of a device according to the invention,

FIG. 2*a* is a cross sectional view through a device according to the present invention, FIG. 2*b* a side view of a device according to the present invention with a filling head in the insertion position, FIG. 2*c* a side view of a device according to the invention with the receiving flask in a tilted insertion position FIG. 3*a*-3*c* are different views of a receiving flask used in accordance with the present invention, FIG. 4 is an exploded view of a filling head in accordance with the present invention, FIG. 5 is an exploded view of a nozzle used in the filling head, FIG. 6 a three dimensional view of a part of the filling head, FIG. 7 is an exploded view of a release element used in context with the present invention, and FIG. 8 a detailed view of a tripping mechanism.

The device 1 comprises a stand or body 2 onto which the elements of the device 1 are mounted. The device 1 comprises a guide rail 4. The guide rail 4 is mounted on the stand 2. A carbonating or filling head 30 is movable along the guide rail 4. On the stand, there is further mounted a receiving flask 20 for receiving a container 10.

The device 1 is provided with housing parts 7*a*, 7*b* for closing the stand 2 and with cover parts 34*a*, 34*b* for covering the filling head 30. A carbon dioxide cylinder (not shown) may be inserted into the device through an opening 5 arranged in the bottom of the device 1 and may be screwed into a threaded connector 11. A carbonating lever 8 is used to open the carbon dioxide cylinder and to allow a gas flow from the carbonating cylinder via a gas conduit (not shown) to a carbonating nozzle 31 arranged in the filling head 30.

The receiving flask 20 is mounted pivotably around an axis B on the stand 2 by means of a hinge 26. The hinge 26 allows rotation of the receiving flask 20 around an axis A as well as tilting of the receiving flask 20 around the axis B. The receiving flask 20 is made of stainless steel and has a diameter of approximately 112 mm and the wall thickness of approximately 0.6 mm. The height h of the receiving flask 20 corresponds to about 70% of the height h of the container 10. The receiving flask 20 is provided with a contact surface 21 on the upper edge of its wall 22.

The filling head 30 is substantially made of a support 45 made of aluminium. The support 45 is provided with pins 33 of a bayonet connection. The pins 33 can be engaged with grooves 23 (see FIG. 3*a* to 3*c*) arranged on the receiving flask 20. The filling head 30 further is provided with a contact surface 32 which is adapted to get into substantially sealing contact with the contact surface 21 of the receiving flasks 20. Sealing contact is made in such a way, that no glass particles can leave the cavity 9 (see. FIG. 2*a*) formed by the receiving flasks 20 and the filling head 30. There is, however, no need for an absolute gas tight seal. The filling head 30 is further provided with a carbonating nozzle 31. The carbonating nozzle 31 is in communication with a connection 46 which can be connected by means of a flexible tube (not shown) to the carbon di-oxide connection 11.

The filling head 30 is further provided with a pressure release or dump button 51. Dump button 51 is arranged on a transmission ring 30 which is rotatably connected to the support 45 by means of screws 36.

By means of the sliding connection of the filling head 30 on the guide rail 4, the filling head can be moved in a direction D between an insertion position in which it is spaced from the receiving flask 20 and a carbonating position in which the contact surface 32 of the filling head 30 is in contact with the contact surface 21 of the receiving flask 20.

In FIG. 1, there is also schematically shown a holding insert 25. The holding insert 25 is formed as a basket which can be inserted into the flask 20.

In FIG. 2*a* a cross section through the device 1 with the filling head 30 in a carbonating position C is shown. Like reference numerals designate like parts as in FIG. 1. The container 10 is filled with a liquid L up to a fill level F. In the carbonating position C, the carbonating nozzle 31 enters into the liquid L. A cavity 9 is formed by the receiving flask 29 and the filling head 30. A float ring 35 floats in the liquid L and closes a seal thereby allowing carbonisation of the liquid (see also FIG. 5).

A wire 14 is shaped into a cam form 15 at its lower end. When the carbonating lever 8 is depressed, a dump trip 64 is actuated allowing a vent pin 57 (see FIG. 7) to close and thus sealing the system ready for carbonation. This sequence is required as the vent pin 57 is opened when the dump lever 51 is depressed and held open by the dump trip 64. In this opened position the machine cannot be pressurised and if gas is released into the machine it will pass straight through tube 54 (see FIG. 4) along with a quantity of water. This wire cam 15 will thus actuate the vent release and allow the machine to be pressurised.

In FIG. 2*a*, a carbon dioxide cylinder 6 is schematically shown in dashed lines. In FIG. 2*a*, the filling head 30 is shown in a carbonating position C. In the carbonating position C a gas G exiting from the carbonating nozzle 31 enters the liquid L. The filling head 30 is supported by a gas spring 3, automatically moving the filling head 30 into the insertion position I (see FIG. 2*b*). In FIG. 2*b* the device 1 is in an insertion position I where the filling head 30 is arranged in a distance from the receiving flask 20 and the container 10. When the filling head 30 is in the insertion position I, the hinge 26 allows tilting of the receiving flask 20 around the axis B (see FIG. 1) until the receiving flask gets in contact with an inclined surface 13 of the stand 2.

The device is further provided with a bottle tilt button 16. When the filling head 30 is raised, the tilt button 16 moves over a cam 17 and contacts the exterior of the flask 20 such as to bring the flask into the tilted position P shown in FIG. 2*c*.

In the tilted position P shown in FIG. 2*c*, the axis A' of the receiving flask 20 is running at an angle $\alpha$ of 15 degrees with respect to an axis A substantially parallel to the movement direction D of filling head 30. The container 10 can be easily removed from the flask 20.

FIG. 3*a* to 3*c* disclose several views of the receiving flask 20. FIG. 3*a* shows a top view. The upper edge of the wall 22 of the receiving flask 20 is provided with grooves 23 which allow insertion of pins 33 of a bayonet connection arranged on the filling head 30.

FIG. 3*b* shows a side view of the receiving flask 20. The upper edge of the wall 22 is formed by a ring 27 attached to the wall 22. The ring 27 is also made of stainless steel. The groove 23 of the bayonet connection is further provided with an engagement surface formed as a ramp 24 (see FIG. 3*c*). The ramp 24 prevents rotation of the receiving flask 20 as long as there is an axial force between the pin 33 and the ramp surface 24. If the pressure within the cavity 9 formed between the filling head 30 and the receiving flask 20 is reduced, axial force is reduced and the pin 33 can be disengaged from the groove 23 by rotation of the flask 20 around the axis A (see FIG. 2*a*).

The filling head 30 is shown in more detail in FIG. 4. The support block 45 is slideably mounted on the guide rail 4. A screw 36 is used to pivotally mount a transmission ring 52 through an opening 53. The dump lever 51 is attached to the transmission ring 52. On support 45, there is further mounted a release element 50 (for more details see also FIG. 6). The release element 50 is provided with a valve pin 57. By actuating the dump lever 51 and thus the transmission ring 52, the vent pin 57 is opened such as to allow release of pressure through the release element 50. A dump trip 64 is used to hold the vent pin 57 open once the dump lever 51 has been activated. The vent pin 57 will be closed by action of the cam 15 (see FIG. 2*a*) on the dump trip 64. A nozzle mount 37 consisting of two parts 37*a*, 37*b* is used for holding the nozzle 31. The release element 50 is further provided with a tube 54 which is sealingly attached to a connector portion 56 of the mount 37*b*. Sealing connection between the tube 54 and the connector 56 is made by means of an O-ring 55.

The nozzle 31 is clamped between the nozzle mount 37*b* and the nozzle mount 37*a*, which are both attached to the support 45. The nozzle 31 is integrally formed with a nozzle support 42 arranged between the mount 37*a* and the mount 37*b*. The nozzle support 42 is further provided with seal 41 for sealingly contacting the upper edge of a bottle which is to be carbonated. Float ring 35 is provided with a spring element 38 attached to a sliding abutment 47 which may abut the nozzle support 42.

In FIG. 4, there is shown the entry of a gas path 43 allowing a flow of gas from cavity 9 (see FIG. 2) via the tube 54 to the release element 50.

The carbonating nozzle 31 will now be shown in more detail in FIG. 5. The carbonating nozzle 31 mainly consists of a hollow tube 39 attached to the nozzle support 42. A sliding abutment 47 is slidingly arranged on the tube 49. At the end of the tube 39 there is arranged a nozzle tip 48 by a threaded connection. A seal element 40 is arranged between the abutment 47 and the nozzle support 42. If there is not sufficient liquid in the container to be carbonated, the float ring 35 will be positioned close to the nozzle tip 48. In this case, the seal 40, e.g. made of a rubber material, is positioned in an intermediate area along the hollow tube 39. As soon as there is sufficient liquid in the container, the float ring 35 will raise and will press the seal 40 against a opening 44 in the nozzle support 42. The seal 40 will close vent holes 44 to the atmosphere such that the machine can pressurise only if there is sufficient water present in the container. A carbonation can be made.

FIG. 6 shows an enlarged view of the nozzle mount 37. A torturous path T is achieved by moulding a series of grooves 49 in the surface of the nozzle mount 37*a*, 37*b* which grooves, when assembled with the carbonating head cover, result in a series of small pathways that, in the event of a bottle burst, will vent gas and some water but not particles of glass.

In FIG. 7 the release element 50 is shown in more detail. The release element 50 comprises a housing formed of a lower part 58*a* and a upper part 58*b*. The housing comprises a interior chamber sealed by means of an O-ring 59. The connection tube 54 is attached to the upper part 58*b* of the housing and is leading into the interior of the housing. A valve pin 57 is arranged axially movable, so as to seal a degassing exit 60. The valve pin 57 is held in a sealing position by means of a spring 61. As soon as the transmission ring 52 (see FIG. 4) is depressed, the valve pin 57 is lifted axially against the spring 61 closing force and opens the exit 60 thus venting the escaping gas to atmosphere.

A pressure control valve 62 and a safety valve 63 are utilised to maintain a working pressure for the carbonation process and limit the maximum pressure achievable in the container and machine. The pressure control valve 62 is set to the working pressure of the machine and is designed to limit the pressure by venting excess gas through the valve 62. In the event of over pressurisation by the user, the safety valve 63 is designed to limit pressure to a maximum and vent excess gas through the valve. These two valves together control the working pressure and maximum pressure of the machine.

Even if glass particles partly should be carried to the exit 60 despite the tortuous path T, exit of glass particles at this location are of no risk for the user.

FIG. 8 shows a tripping mechanism. When the head 30 is released from the flask 20, the head 30 will rise pushed by a gas spring 3. During this upward travel, valve plungers 65, 66 (see. FIG. 7) will contact the lower surface of a moving cam slider 70 (see FIG. 8). As this cam slider 70 is free to move it will be pushed upward along the guide path on a fixed cam 71. As this guide path is at an angle to the vertical travel, the cam slider 70 and plungers 65, 66 will diverge as they travel upwards, eventually separating, thus allowing the slider cam 70 to return to a lower rest position. When the head 30 is pushed down by the user, the valve plungers 65, 66 come into contact with the cam and are forced to open the valves 62, 63 as they rise over the cam 70. The actuation of the valves occurs only during the downward travel as the force required is too high for the gas strut to overcome during the upward travel.

The invention claimed is:

1. A device for carbonating a liquid contained in a container with a pressurized gas comprising a flask for receiving said container, a filling head having means for adding said gas into a liquid in said container, wherein said receiving flask and said filling head are each mounted on a stand, wherein said receiving flask and said filling head are movable in relation to each other between an insertion position and a carbonating position, wherein in the insertion position the filling head is spaced away from said receiving flask such that said container can be placed into said flask, wherein in said carbonating position a circumferential contact surface of said receiving flask and a circumferential contact surface of said filling head are in substantially sealing contact with each other such as to form a substantially closed cavity and wherein the filling head and the receiving flask are provided with locking means for interlocking connection there between.

2. A device according to claim 1 wherein the locking means are a bayonet connection.

3. A device according to claim 1 wherein the receiving flask has a wall having a height of at least 50% of the height of said container.

4. A device according to claim 1, wherein said device is provided with a pressure release element for releasing overpressure in said container and/or said cavity.

5. A device according claim 4, wherein said interlocking connection between said flask and said filling head is comprise a safety mechanism designed in such a way, that said interlocking connection between said flask and said filling head can be disengaged only if the pressure in said cavity and/or said container has been released.

6. A device according to claim 3, wherein said interlocking engagement between said flask and said filling head is made by means of pins of a bayonet connector and grooves and wherein said grooves are provided with ramp surface, inclined in such a way that the disengagement of the interlocking connection is prevented until the pressure in the cavity and/or in the bottle has been released.

7. A device according to claim 1, wherein the device is provided with spring means for automatically moving said filling head and/or said receiving flask into the insertion position, when the interlocking connection between the filling head and the receiving flask has been disengaged.

8. A device according to claim 1, wherein said receiving flask is made of a metal.

9. A device according to claim 8, wherein said receiving flask is made of stainless steel.

10. A device according to claim 1, wherein said filling head comprises a support made of a metal.

11. A device according to claim 10, wherein said support is made of aluminum.

12. A device according to claim 1, wherein the receiving flask is provided with a holding insert for holding said container.

13. A device according to claim 12, wherein the holding insert is made of a resilient material.

14. A device according to claim 1, wherein the device has a path for release of gas from said cavity and/or from said container.

15. A device according to claim 14, wherein said path is formed in a curved manner in such a way that glass particles carried in a gas stream are held back in said path.

16. A device according to claim 1, wherein the device comprises a stand, which is provided with an opening in its standing surface and wherein said opening is axially aligned with a carbon dioxide connector, such that a carbon dioxide cylinder can be inserted through that opening without lifting said device.

17. The combination of a device according to claim 1 and of at least one container made of glass.

18. A device for carbonating a liquid contained in a container with a pressurized gas comprising a flask for receiving said container, a filling head having means for adding said gas into a liquid in said container, wherein said receiving flask and said filling head are movable in relation to each other between an insertion position and a carbonating position, wherein in the insertion position the filling head is spaced away from said receiving flask such that said container can be placed into said flask, wherein said receiving flask is rotatably mounted on a stand having an axis of rotation substantially parallel to the movement direction of the flask and/or the filling head, wherein in said carbonating position a contact surface of said receiving flask and a contact surface of said filling head are in contact with each other such as to form a substantially closed cavity and wherein the filling head and the receiving flask are provided with locking means for interlocking connection there between.

19. A device for carbonating a liquid contained in a container with a pressurized gas comprising a flask for receiving said container, a filling head having means for adding said gas into a liquid in said container, wherein the flask is tiltably mounted on a stand, wherein said receiving flask and said filling head are movable in relation to each other between an insertion position and a carbonating position, wherein in the insertion position the filling head is spaced away from said receiving flask such that said container can be placed into said flask, wherein in said carbonating position a contact surface of said receiving flask and a contact surface of said filling head are in contact with each other such as to form a substantially closed cavity and wherein the filling head and the receiving flask are provided with locking means for interlocking connection there between.

20. A device according to claim 19 wherein the receiving flask is mounted such that it is automatically moved into a tilted position where the axis of with respect to the movement direction of the filling head and/or said flask, when the device is in the insertion position.

21. A device according to claim 20 wherein the flask is angled at an angle of about 15 degrees.

22. A device for carbonating a liquid contained in a container with a pressurized gas comprising a flask for receiving said container, a filling head having means for adding said gas into a liquid in said container, wherein said receiving flask and said filling head are movable in relation to each other between an insertion position and a carbonating position, wherein said filling head is movable along a guide rail mounted on a stand, wherein in the insertion position the filling head is spaced away from said receiving flask such that said container can be placed into said flask, wherein in said carbonating position a contact surface of said receiving flask and a contact surface of said filling head are in contact with each other such as to form a substantially closed cavity and wherein the filling head and the receiving flask are provided with locking means for interlocking connection there between.

23. A device for carbonating a liquid contained in a container with a pressurized gas comprising a flask for receiving said container, a filling head having means for adding said gas into a liquid in said container, wherein said receiving flask and said filling head are movable in relation to each other between an insertion position and a carbonating position, wherein in the insertion position the filling head is spaced away from said receiving flask such that said container can be placed into said flask, wherein in said carbonating position a contact surface of said receiving flask and a contact surface of said filling head are in contact with each other such as to form a substantially closed cavity, wherein the filling head and the receiving flask are provided with locking means for interlocking connection therebetween, and wherein said filling head is provided with a float member allowing pressurization of said container only if said container is filled with the liquid to at least a predetermined fill level.

24. A device for carbonating a liquid contained in a container with a pressurized gas comprising a flask for receiving said container, a filling head having means for adding said gas into a liquid in said container, wherein said receiving flask and said filling head are movable in relation to each other between an insertion position and a carbonating position, wherein in the insertion position the filling head is spaced away from said receiving flask such that said container can be placed into said flask, wherein in said carbonating position a contact surface of said receiving flask and a contact surface of said filling head are in contact with each other such as to form a substantially closed cavity, wherein the filling head and the receiving flask are provided with locking means for interlocking connection therebetween, and wherein said device is provided with a generator for creating electrical energy.

* * * * *